United States Patent [19]

Guebert et al.

[11] 4,213,492

[45] Jul. 22, 1980

[54] DRAPERY ROD CLIP

[76] Inventors: Gerald E. Guebert, 3039 Eric La., Farmers Branch, Tex. 75234; Raymond R. Belknap, 125 Star, Austin, Tex. 78734

[21] Appl. No.: 948,433

[22] Filed: Oct. 4, 1978

[51] Int. Cl.[2] ..... A47H 1/00

[52] U.S. Cl. ..... 160/124; 160/330

[58] Field of Search ..... 160/19, 123, 124, 125, 160/126, 330, 383, 389, 399, 402; 24/73 AP, 73 PF, 84 R, 257

[56] References Cited

U.S. PATENT DOCUMENTS

| | | | |
|---|---|---|---|
| 740,684 | 10/1903 | Needham | 160/402 |
| 2,606,733 | 8/1952 | Krajewski | 160/126 |
| 3,437,127 | 4/1969 | Lukashok | 160/330 |
| 3,905,414 | 9/1975 | Guebert et al. | 160/330 |

*Primary Examiner*—Peter M. Caun

*Attorney, Agent, or Firm*—Hubbard, Thurman, Turner, Tucker & Glaser

[57] ABSTRACT

A connector clip for attaching drapery to a cylindrical support member such as, for example, a horizontal pipe, comprising a face portion having a fastener on a front surface thereof and upper and lower legs extending from the upper and lower edges of the face portion. The upper leg extends transversely from the face portion and terminates in a curved jaw conforming to the pipe surface. The lower leg comprises a curvilinear member extending tangentially from the face portion to a point near the back of the face where it terminates in a second jaw, having a curved surface for engaging the supporting pipe in opposition to the jaw of the upper leg. In a preferred form, the upper leg is joined to the face portion by a half cylinder spring section extending transversely from the front of the face portion and joining the upper leg tangentially.

7 Claims, 4 Drawing Figures

DRAPERY ROD CLIP

BACKGROUND OF THE INVENTION

This invention relates generally to decorative drapery systems and more particularly to a clip for connecting drapery to cylindrical support members for use as backdrops and the like.

Prior art believed to be particularly relevant to the present invention includes U.S. Pat. No. 3,905,414 issued to the inventors of the present invention on Sept. 16, 1975. That patent teaches a connector assembly for attaching drapery to the edge of a table or elevated platform or the like. Such decorative drapery is typically used at various public meetings, banquets, theatrical performances, etc. As taught in that patent, the tables or stages or other platforms typically have a fairly square edge to which a similarly shaped clip may be firmly attached to support the drapery.

Another reference believed relevant to the present invention is U.S. Pat. No. 3,437,127 issued to Lukashok on Apr. 8, 1969. This patent teaches a spring clip made to conform to the shape of a fairly flat standard curtain rod for supporting drapery. The clip is simply snapped on to the curtain rod and drapery is hung by means of a hook which is hingedly connected to the clip.

It is common practice in large public meetings or banquets, etc., to provide a decorative backdrop curtain or drapery which is typically supported by means of a cylindrical support member such as a long section of steel pipe. As noted in the above-referenced patent 3,905,414, the decorative draperies are often installed only temporarily for specific functions and are desirably removed and stored when the facility is used for other purposes. It is desirable, therefore, that the drapery be easily installed and removed from the supporting structure which may be, for example, the horizontal pipe. It can be seen that a simple clip which simply conforms to the shape of the supporting structure in a manner similar to that taught in the two above-referenced patents, will not efficiently resist rotational forces when a supporting structure is cylindrical. It is also apparent that when hanging drapery from a cylindrical support, that it is desirable that the drapery hang from a front face of the support to thereby cover the supporting pipe and provide a natural pleasing appearance.

SUMMARY OF THE INVENTION

Accordingly, an object of the present invention is to provide an improved clip for connecting drapery to a cylindrical support element.

Another object of the present invention is to provide a drapery hanging clip which effectively resists the rotational force caused by the weight of the supported drapery material.

A drapery hanging clip according to the present invention, includes a face portion having a fastener means on a front surface adapted for engaging a mating fastener on a drapery and upper and lower legs extending generally from the back of said face portion. The upper leg extends transversely from the face portion and terminates in a curved jaw having a radius of curvature corresponding to the cylindrical support member. The lower leg extends tangentially from the bottom of the face portion and includes a curvilinear portion which extends to a point near the back of the face portion where it terminates in a second curved jaw, also having a radius of curvature corresponding to the cylindrical support member.

BRIEF DESCRIPTION OF THE DRAWING

The present invention may be better understood by reading the following detailed description of the preferred embodiment with reference to the attached drawings wherein.

DESCRIPTION OF THE PREFERRED EMBODIMENT

Figure 1:
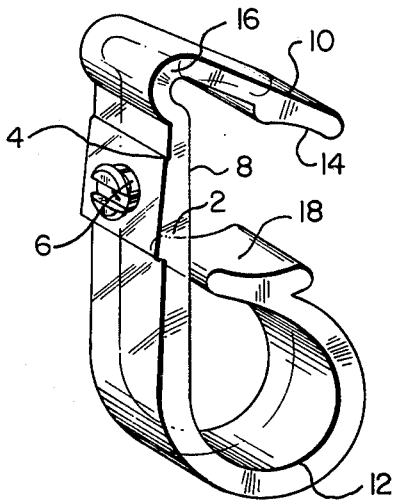
FIG. 1 is a perspective view of a drapery hanging clip according to the present invention.

A drapery hanging clip according to the present invention is illustrated in FIG. 1. This clip includes a central face portion 2 having a front surface 4 which supports a male fastener element 6. While a particular male fastener is illustrated, any of the various forms such as those illustrated in U.S. Pat. No. 3,905,414 would be suitable. The particular element 6 may function as either a simple snap connector or a locking connector, depending upon the form of the female fastener to which it is connected. Extending generally from the backside 8 of the face portion 2 is an upper leg 10 and a lower leg 12. The angle between the upper leg 10 and the back 8 of face 2 is generally somewhat less than 90°. The end of leg 10 terminates in a curved jaw 14, having a radius of curvature preferably selected to be substantially equal to the radius of a particular cylindrical support element. In a preferred form as illustrated, leg 10 is connected to face portion 2 by means of a generally half cylindrical spring portion 16. This portion actually extends transversely from the front 4 of face portion 2 and connects tangentially with the upper leg 10. This portion 16 is preferred for adding both strength and flexibility to the junction of leg 10 with face portion 2, which junction is the major load bearing portion of the clip.

The lower leg 12 extends tangentially from the lower portion of face member 2 and extends in a curvilinear fashion to a point adjacent the back 8 of the face portion 2. The radius of curvature of lower leg 12 is on the order of the radius of the cylindrical support element. Lower leg 12 terminates in a second curved jaw 18, preferably having a radius of curvature substantially equal to that of the cylindrical support element. Jaws 14 and 18 generally oppose each other, so that upon being spread apart they may frictionally engage a cylindrical support on essentially opposite sides.

Figure 2:
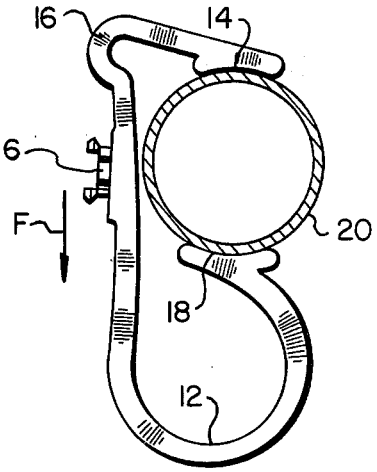
FIG. 2 is an elevational view of the drapery hanging clip of the present invention shown engaged with a cylindrical support member.

FIG. 2 is an elevational view of the clip shown in FIG. 1 in frictional engagement with a cylindrical support element. The support element 20 is typically a length of steel pipe having an outer diameter of, for example, 1¼ inches. It can be seen in FIG. 2 that when jaws 14 and 18 are thus positioned on the pipe, they frictionally engage the pipe in essentially direct opposition to each other. While in FIG. 1 the curved jaws 14 and 18 appear to be misaligned, the positioning is intentional. With an essentially straight transverse leg such as upper leg 10, the jaw 14 moves in a direction essentially parallel to the face portion 2 when the jaws are spread apart. In contrast, the jaw 18 moves away from face portion 2 when it is spread from jaw 14 for mounting on the support 20. This motion of jaw 18 is due to the large diameter of curvilinear portion of leg 12 which tends to uncurl when the jaws are forcefully spread apart. As can be seen in FIG. 2, when the jaws 14 and 18 are spread sufficiently to mate with the support 20, they are in correct alignment with each other, so that both curved faces of jaws 14 and 18 may contact the outer surface of the support over substantially their entire areas.

The particular motion of jaw 18 achieved by use of the curvilinear portion of leg 12, has been found to provide a distinct advantage in the drapery hanging clip of the present invention. When drapery is connected to the fastener 6, the weight of the drapery applies a force to the fastener 6 in a direction indicated by the arrow marked F in FIG. 2. This force, of course, tends to rotate the supporting clip on the pipe 20 and the rotation can be stopped only if there is sufficient friction between the surfaces of jaws 14 and 18 and the pipe surface. The use of the curvilinear lower leg 12 has been found to apparently couple part of the force F to the jaws 14 and 18 in such a way as to increase the friction and prevent rotation of the clip on support 20. This arrangement has been found to be much more effective than a simple spring clip conforming essentially to the shape of the support 20 itself.

The drapery hanging clips according to the present invention are preferably made from a resilient material such as a thermoplastic material that can be injection molded. The preferred plastic is a polycarbonate material although other materials such as polystyrene, ABS and the like could be used. In any event, the material used must have sufficient resilience, strength, and flexibility to allow it to be snapped on to the support rod and to support the drapery materials, which may be typically very heavy.

Figure 3:
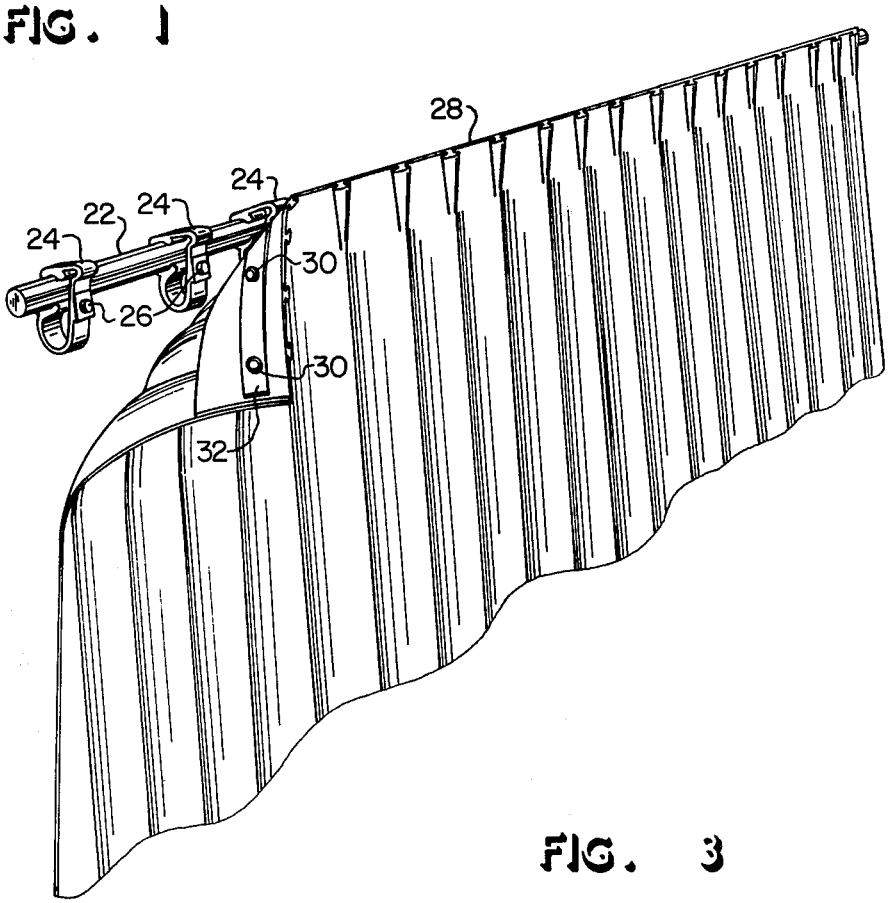
FIG. 3 is an illustration of a drapery backdrop assembly according to the present invention.

With reference now to FIG. 3, there is illustrated a backdrop assembly according to the present invention. This assembly includes a supporting pipe 22 to which is attached a number of clips 24 in the manner illustrated in FIG. 2. Each of the clips 24 carries a male fastener element 26 on its exposed front face. A drapery panel 28 is shown partially installed on a supporting pipe 22. A number of female fastener elements 30 are disposed along the back surface of the heading of drapery panel 28. Fastener elements 30 are, of course, selected to matingly engage the fastener elements 26 on the clips 24. The fastener elements 30 may be individually attached to the drapery panel 28 by sewing or other suitable methods. As noted in the above reference U.S. Pat. No. 3,905,414, the preferred assembly includes a strip of material 32 carrying the fasteners 30 with the strip 32 sewn to the heading in a conventional manner. In the preferred form, the strip 32 is a nylon tape approximately 1 to 2 inches in width, carrying fasteners 30 disposed approximately 8 inches apart along its length. As illustrated, the backdrop may be assembled by attaching the clips 24 to pipe 22 with spacings corresponding to the spacings of the mating fasteners 30 on the drapery panel 28. Panel 28 is then hung by simply snapping on to the clips 24. If desired, the clips 24 may, of course, be attached to the drapery panel 28 before being attached to the pipe 22. If locking-type fastener elements are employed on the clips 24 and drapery panel 28, this latter method is preferred since the clips would have to be rotated relative to the panel for the fastener elements to engage.

Figure 4:
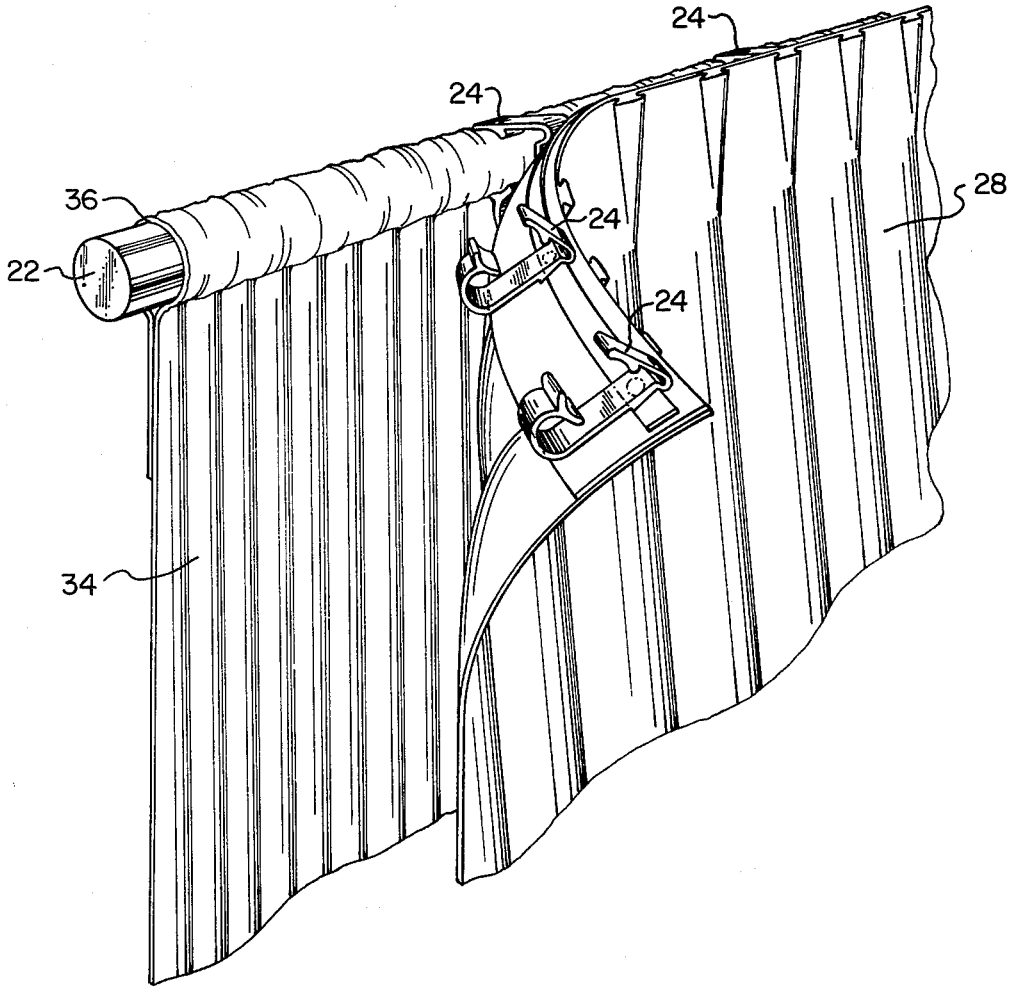
FIG. 4 is an illustration of another backdrop assembly according to the present invention.

With reference now to FIG. 4, there is illustrated another backdrop assembly according to the present invention. In particular, FIG. 4 illustrates a method of re-draping or draping over an existing backdrop type drape. In most trade shows, the backdrop support 22 is provided with a basic show drape 34 which is attached to the support by means of a rod pocket 36 sewn into the top. It can be seen that when such an arrangement has been provided, it would be time-consuming and difficult to dismantle the backdrop assembly to remove the show drape 34 and replace it with a personalized or more decorative drape. Such dismantling and replacing may not be allowed by the trade show management since the particular drape 34 may be a divider between adjacent trade show booths.

In such a case, the decorative or personalized drapery 28 may be attached to the support 22 by means of drapery rod clips 24 without damaging or disturbing the basic show drape 34. As illustrated in FIG. 4, the clips 24 may be first attached to the mating fasteners on drape 28 and then installed on support 22 directly over the rod pocket 36 of primary drape 34. This arrangement does not damage the primary drape 34 and allows the drape 28 to be installed quickly and easily. If the drape 34 is in fact the divider between adjacent booths, this arrangement will not interfere with the function of drape 34 for the adjacent booth. If the user of the adjacent booth desires to use his own personalized drape over primary drape 34, it may be installed in similar fashion on the other side of support 22 by simply attaching supporting rod clips, such as clips 24, in an interleaved fashion with those illustrated in FIG. 4.

The term "drapery" is used here in its general sense and is intended to include any type of skirting, curtains, trimmings, or the like formed of any type of material or fabric used for decorating or enhancing the appearance of the item to which it is attached. Generally, the material is arranged in loose folds or pleats.

While the present invention has been illustrated in terms of a particular apparatus, it is apparent that various modifications and changes can be made within the scope of the present invention as defined by the appended claims.

We claim:

1. A connector clip for attachment of drapery to a cylindrical support member comprising:
   - a face portion having front and back surfaces;
   - fastener means disposed on the front surface of said face portion for detachably coupling with respective fastener means affixed to said drapery;
   - an upper leg having a first end connected to said face portion, said upper leg extending transversely away from the back of said face portion;
   - a first curved jaw carried by a second end of said upper leg for engaging said cylindrical support;
   - a lower leg having a first end connected to said face portion, said lower leg including a curvilinear portion extending tangentially from said face portion to a point spaced from the back surface of said face portion; and
   - a second curved jaw carried by a second end of said lower leg for engaging said cylindrical support in opposition to said first curved jaw.

2. A connector clip according to claim 1 wherein said upper leg is attached to said face portion by means of a half cylindrical section extending transversely from the front of said face portion and intersecting said upper leg tangentially, whereby the junction of said upper leg to said face portion is both strengthened and made more flexible.

3. A connector clip according to claim 1 wherein said fastener means is a male fastener adapted to temporarily lock into a female fastener means affixed to a drapery.

4. A connector clip according to claim 1 wherein the curvilinear portion of said lower leg is substantially circular and and has a diameter approximately equal to the diameter of the cylindrical support member.

5. A connector clip according to claim 1 wherein said first curved jaw and said second curved jaw each have a surface substantially conforming to the outer surface of said cylindrical support.

6. A drapery assembly for use as a backdrop or the like having a horizontally disposed cylindrical support member for said drapery comprising:

a plurality of clips resiliently and slideably clamped onto and along said cylindrical support, each of said clips comprising:

a face portion having front and back surfaces;

fastener means disposed on the front surface of said face portion for for detachably coupling with respective fastener means affixed to said drapery;

an upper leg having a first end connected to said face portion, said upper leg extending transversely away from the back of said face portion;

a first curved jaw carried by a second end of said upper leg for engaging said cylindrical support;

a lower leg having a first end connected to said face portion, said lower leg including a curvilinear portion extending tangentially from said face portion to a point spaced from the back surface of said face portion;

a second curved jaw carried by a second end of said lower leg for engaging said cylindrical support in opposition to said first curved jaw;

each of said clips clamped to said support member by means of said first and second jaws; and, drapery means having a plurality of fastener means detachably coupled to respective ones of said clip fastener means.

7. A drapery assembly according to claim 6, further including a primary drape attached to said cylindrical support by means of a rod pocket formed in the top of said primary drape, said rod pocket surrounding said cylindrical support and interposed between said first and second jaws and said cylindrical support.

* * * * *